US010320111B2

(12) United States Patent
Dai et al.

(10) Patent No.: US 10,320,111 B2
(45) Date of Patent: Jun. 11, 2019

(54) ELECTRICAL CONNECTION DEVICE

(71) Applicant: LOTES CO., LTD, Keelung (TW)

(72) Inventors: Yong Jun Dai, Keelung (TW); Zuo Feng Jin, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/864,189

(22) Filed: Jan. 8, 2018

(65) Prior Publication Data

US 2018/0309226 A1 Oct. 25, 2018

(30) Foreign Application Priority Data

Apr. 24, 2017 (CN) ..... 2017 2 0428993 U

(51) Int. Cl.

*H01R 12/70* (2011.01)
*H01R 12/72* (2011.01)
*H01R 12/77* (2011.01)
*H01R 13/512* (2006.01)

(52) U.S. Cl.

CPC ..... *H01R 13/512* (2013.01); *H01R 12/7047* (2013.01); *H01R 12/721* (2013.01); *H01R 12/772* (2013.01)

(58) Field of Classification Search

CPC ..... H01R 13/6215; H01R 23/722; H01R 23/7068; H01R 12/79; H01R 13/512; H01R 12/721; H01R 12/772; H01R 12/7047

USPC ..... 439/359, 361, 329, 370, 951

See application file for complete search history.

(56) References Cited

U.S. PATENT DOCUMENTS 4,583,800 A * 4/1986 Roberts ..... H05K 3/365 439/329
4,695,258 A * 9/1987 Hanson ..... H01R 12/79 439/329
4,768,971 A * 9/1988 Simpson ..... H01R 23/6813 439/329
4,948,374 A * 8/1990 Carter ..... H01R 12/62 439/329
5,049,090 A * 9/1991 Johnson ..... H01R 12/62 439/329
5,213,511 A * 5/1993 Sobhani ..... H01R 12/61 439/329

(Continued)

FOREIGN PATENT DOCUMENTS

CN 1725387 A 1/2006
CN 2779650 Y 5/2006

*Primary Examiner* — Gary F Paumen
(74) *Attorney, Agent, or Firm* — Locke Lord LLP; Tim Tingkang Xia, Esq.

(57) ABSTRACT

An electrical connection device has a first insulating body. A strip-shaped first conductor is accommodated in the first insulating body. The first conductor as a whole is arranged horizontally to electrically connect backward with a first docking component. A bottom surface of the first conductor has a front edge, and a contact area extends backward from the front edge. A second docking component includes a second conductor located below the first conductor. The second conductor has a front end, a rear end, and a top surface connecting the front and rear ends. An elastic body is located above the first conductor and downwardly abuts the first conductor. A pressing piece provides a downward force to make the first conductor downwardly abut the second conductor.

16 Claims, 11 Drawing Sheets

(56) References Cited

U.S. PATENT DOCUMENTS

| | | | | | |
|---|---|---|---|---|---|
| 5,263,868 | A * | 11/1993 | Renn | H01R 9/096 | 361/789 |
| 5,297,968 | A * | 3/1994 | Johnson | H01R 12/78 | 439/329 |
| 5,707,241 | A * | 1/1998 | Hamlin | H01R 12/62 | 439/329 |
| 5,980,296 | A * | 11/1999 | Mori | H01R 23/661 | 439/329 |
| 6,045,396 | A | 4/2000 | Tighe | | |
| 6,247,951 | B1 * | 6/2001 | Di Liello | H01R 12/61 | 439/329 |
| 6,520,789 | B2 * | 2/2003 | Daugherty, Jr. | H01R 9/096 | 439/329 |
| 7,359,208 | B2 * | 4/2008 | Ni | G11B 33/12 | 174/50.51 |
| 7,455,531 | B2 * | 11/2008 | Hirabayashi | H01R 13/025 | 174/154 |
| 7,581,975 | B1 | 9/2009 | Liu et al. | | |
| 8,251,712 | B2 * | 8/2012 | Cheng | H01R 12/7082 | 439/329 |
| 2004/0157482 | A1 * | 8/2004 | Tomonari | H01R 12/79 | 439/329 |

* cited by examiner

C–C

A-A

ELECTRICAL CONNECTION DEVICE

CROSS-REFERENCE TO RELATED APPLICATION

This non-provisional application claims priority to and the benefit of, pursuant to 35 U.S.C. § 119(a), Patent Application Serial No. 201720428993.1 filed in P.R. China on Apr. 24, 2017, the entire content of which is hereby incorporated by reference.

FIELD OF THE INVENTION

The present invention relates to an electrical connection device, and in particular to an electrical connection device for high-frequency signal transmission.

BACKGROUND OF THE INVENTION

In various electrical connection devices, it is common that two conductors are separably pressed and connected, such as a terminal and a terminal, a terminal and a conductive sheet, a terminal and a cable. In order to guarantee the stability of the press and connection, an elastic body is usually adopted to apply elastic force to the two conductors, as shown in a Chinese patent (Patent Number: 200520053929.7). The electrical connector shown in that Chinese patent has an elastic body, which presses a conductor of a cable to be pressed and connected to a conductive sheet of a circuit board, and a conductive path is formed between the conductor and the conductive sheet. However, an end of the conductor bends upward, failing to contact the conductive sheet, and an open circuit is formed. As a result, there is a electrical stub effect, which affects the quality of signal transmission, and in particular, in high-frequency signal transmission, the negative influence of the electrical stub effect is especially evident, causing severe signal distortion.

Therefore, a heretofore unaddressed need to design a new electrical connection device exists in the art to address the aforementioned deficiencies and inadequacies.

SUMMARY OF THE INVENTION

In view of the deficiencies as discussed above, an objective of the present invention is to provide a novel electrical connection device in order to eliminate the electrical stub effect produced between two separably crimped conductors, so that the quality of signal transmission can be enhanced.

To achieve the foregoing objective, one aspect of the invention provides an electrical connection device, which includes a first insulating body; a strip-shaped first conductor, accommodated in the first insulating body, wherein the first conductor as a whole is arranged horizontally, and is configured to electrically connect backward with a first docking component, a bottom surface of the first conductor has a front edge, and a contact area extends backward from the front edge; a second docking component, including a second conductor located below the first conductor, wherein the second conductor has a front end and a rear end opposite to each other and a top surface connecting the front end and the rear end; an elastic body, located above the first conductor and downwardly abutting the first conductor; and a pressing piece, configured to provide a downward force to make the first conductor downwardly abut the second conductor, wherein when the pressing piece applies pressure, the contact area is completely attached to the top surface, the front edge is located between the front end and the rear end and abuts the top surface, and the rear end abuts the contact area.

In certain embodiments, an area of the first conductor pressed by the elastic body extends to right above the front edge.

In certain embodiments, the contact area is narrow at a front and wide at a rear thereof.

In certain embodiments, the second docking component is a circuit board, the second conductor comprises a signal pad, the circuit board has a signal wire and a connector which is electrically connected to the signal wire, the connector has a connecting point abutting the signal pad, and in a horizontal projection, the connecting point is located between the front end and the front edge.

In certain embodiments, the connecting point is electrically connected to the front end.

In certain embodiments, the second docking component further includes: a third conductor, accommodated in the first insulating body, and arranged to be vertically symmetric with the first conductor; and a fourth conductor, arranged to be vertically symmetric with the second conductor.

In certain embodiments, the electrical connection device further includes: an insulating piece, located between the elastic body and the pressing piece and downwardly abutting the elastic body, wherein the pressing piece downwardly abuts the insulating piece; an elastic component, located below the third conductor and upwardly abutting the third conductor; an insulating block, upwardly abutting the elastic component; and a pressing component, configured to provide an upward force to abut the insulating block to make the third conductor upwardly abut the fourth conductor.

In certain embodiments, the pressing piece is a screw bolt passing through the insulating piece and the insulating block from above to below, and the pressing component is a screw nut matching with the screw bolt.

In certain embodiments, the second docking component is a circuit board, the second conductor comprises a grounding pad, the circuit board is provided with an accommodating hole, a conducting piece is accommodated in the accommodating hole, and the second conductor and the fourth conductor are electrically connected with each other via the conducting piece.

In certain embodiments, the conducting piece is located right below the contact area.

In certain embodiments, the accommodating hole upwardly passes through the second conductor to expose the conducting piece on the top surface.

In certain embodiments, the conducting piece abuts the contact area.

In certain embodiments, the conducting piece is vertically arranged, and in a horizontal projection, the conducting piece is located between the front edge and the front end.

In certain embodiments, the circuit board has a grounding wire, and the conducting piece is electrically connected to the grounding wire.

In certain embodiments, a length of the front edge is ⅓ of a length of the front end.

In certain embodiments, the elastic body backwardly abuts the first insulating body.

In certain embodiments, the second docking component has a notch spaced away from the pressing piece.

Compared with the art, certain embodiments of the invention have the following beneficial advantages: in the electrical connection device, the first conductor and the second conductor are in a tight contact under external force; the contact area is completely attached to the top surface; the front edge is located between the front end and the rear end and abuts the top surface; and the rear end abuts the contact area. Consequently, there is no open circuit caused by a branch between the first conductor and the second conductor, thus eliminating the negative influence of the electrical stub effect on signal transmission, enhancing the quality of signal transmission, and decreasing the degree of distortion of high-frequency signal transmission.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
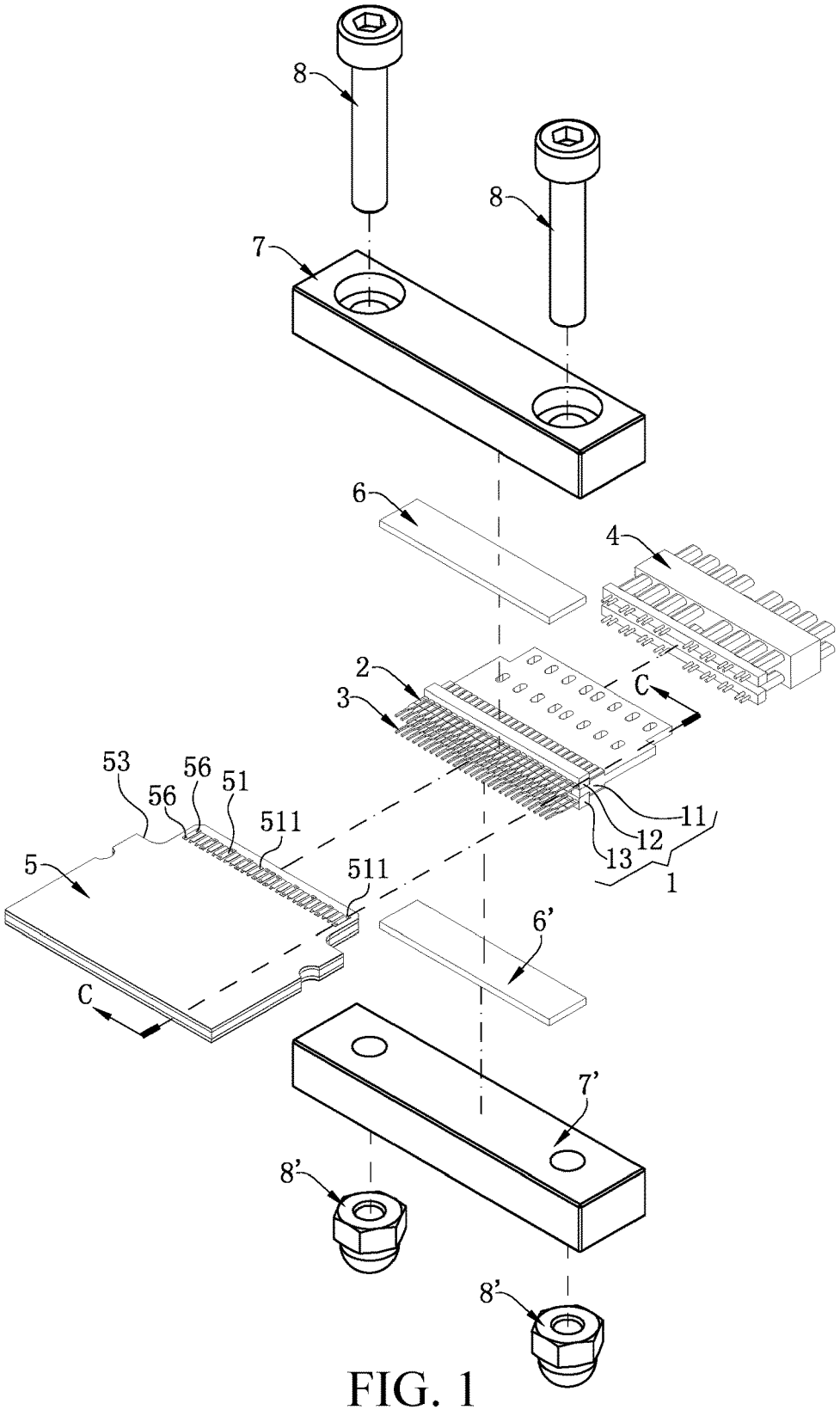
FIG. 1 is a three-dimensional exploded view of an electrical connection device according to one embodiment of the present invention.
Figure 2:
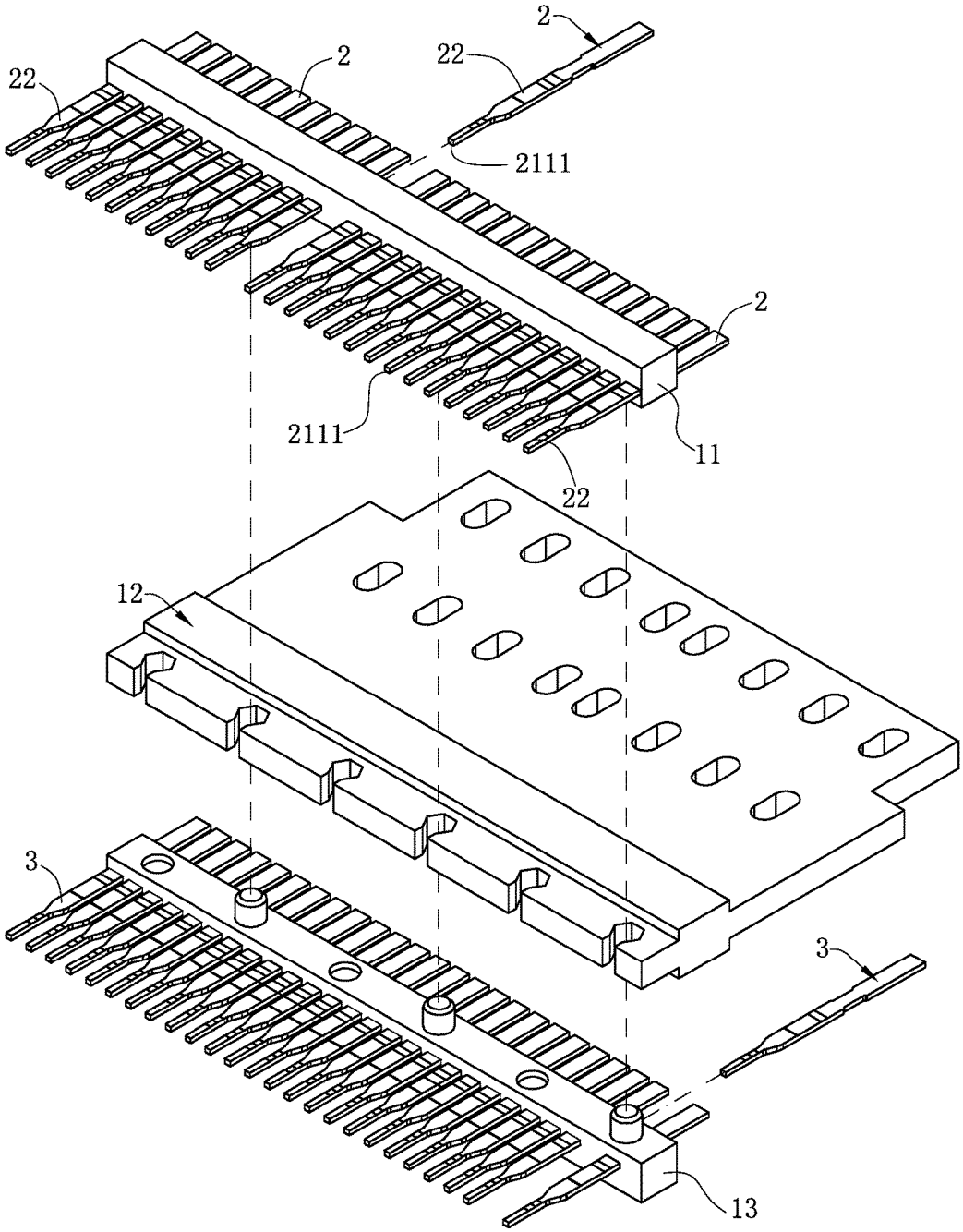
FIG. 2 is a local three-dimensional exploded view of the electrical connection device according to one embodiment of the present invention.
Figure 3:
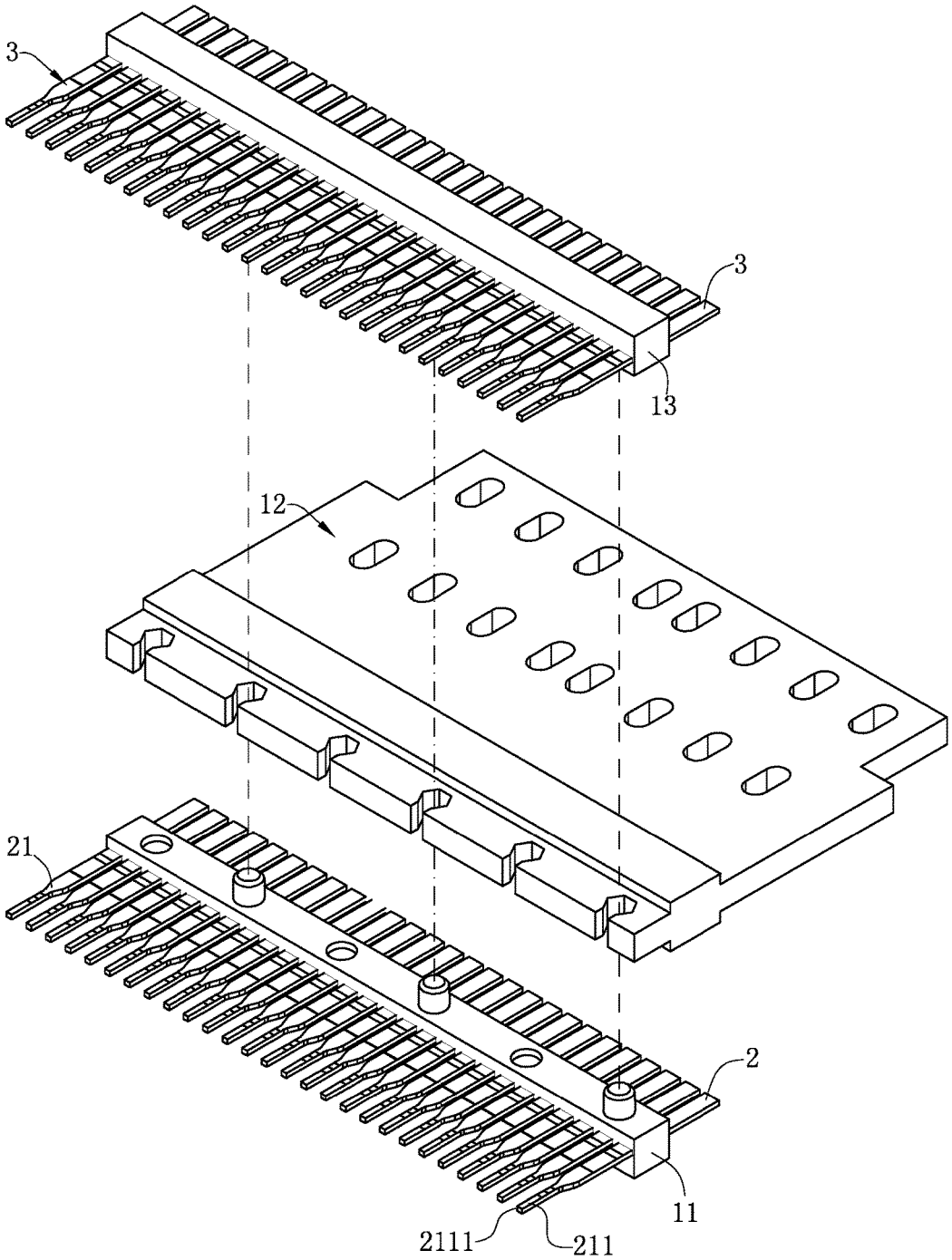
FIG. 3 is a local three-dimensional exploded view, viewed from another viewing angle, of the electrical connection device according to one embodiment of the present invention.
Figure 4:
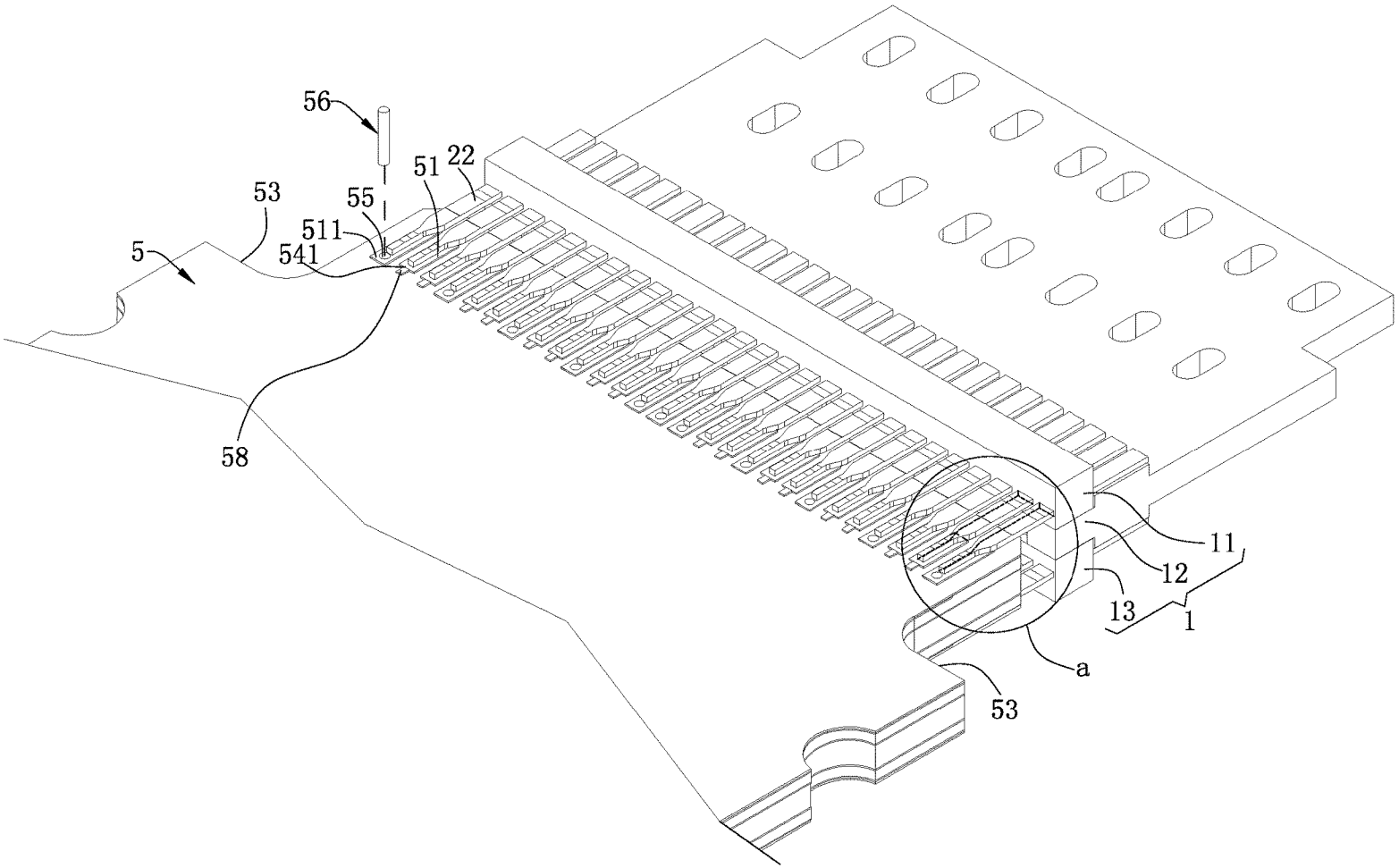
FIG. 4 is a local three-dimensional view of the electrical connection device according to one embodiment of the present invention.
Figure 5:
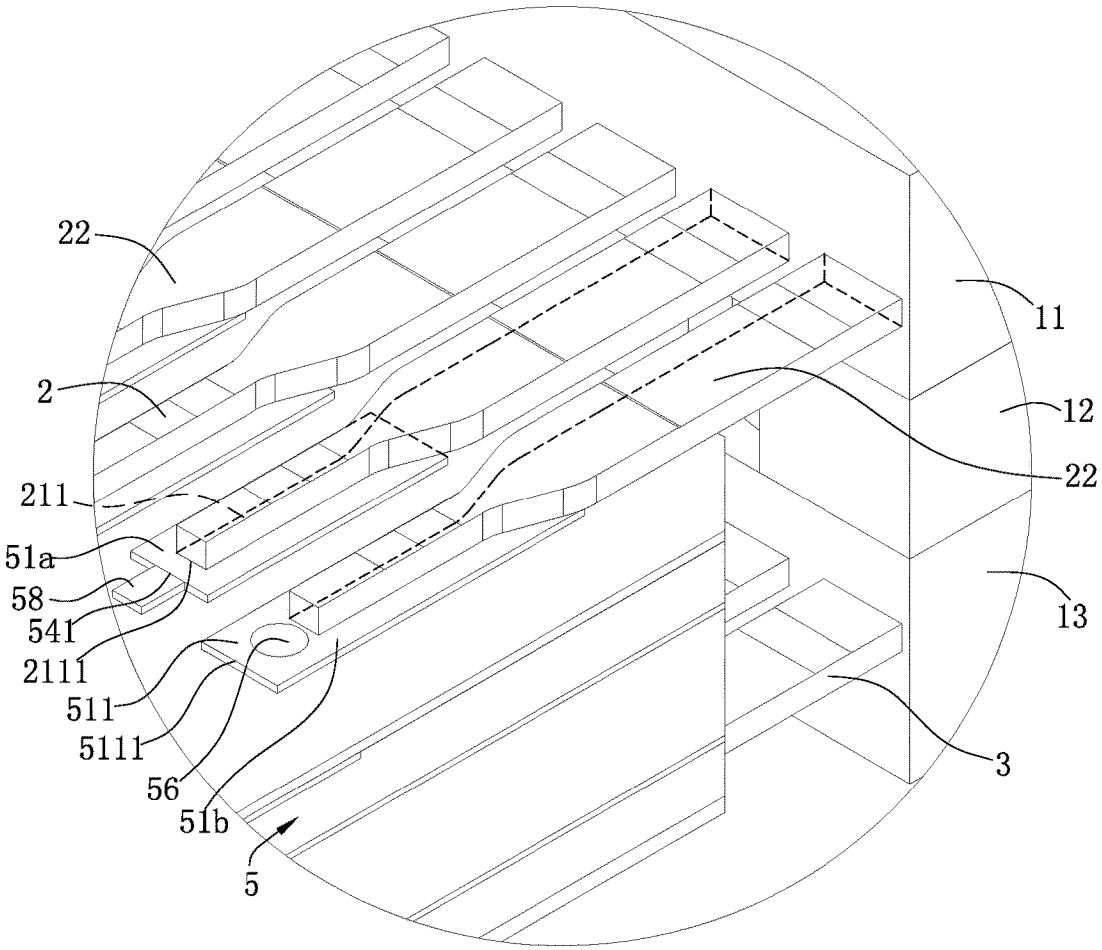
FIG. 5 is an enlarged view of part a in FIG. 4.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-11. In accordance with the purposes of this invention, as embodied and broadly described herein, this invention, in one aspect, relates to an electrical connection device.

Figure 7:
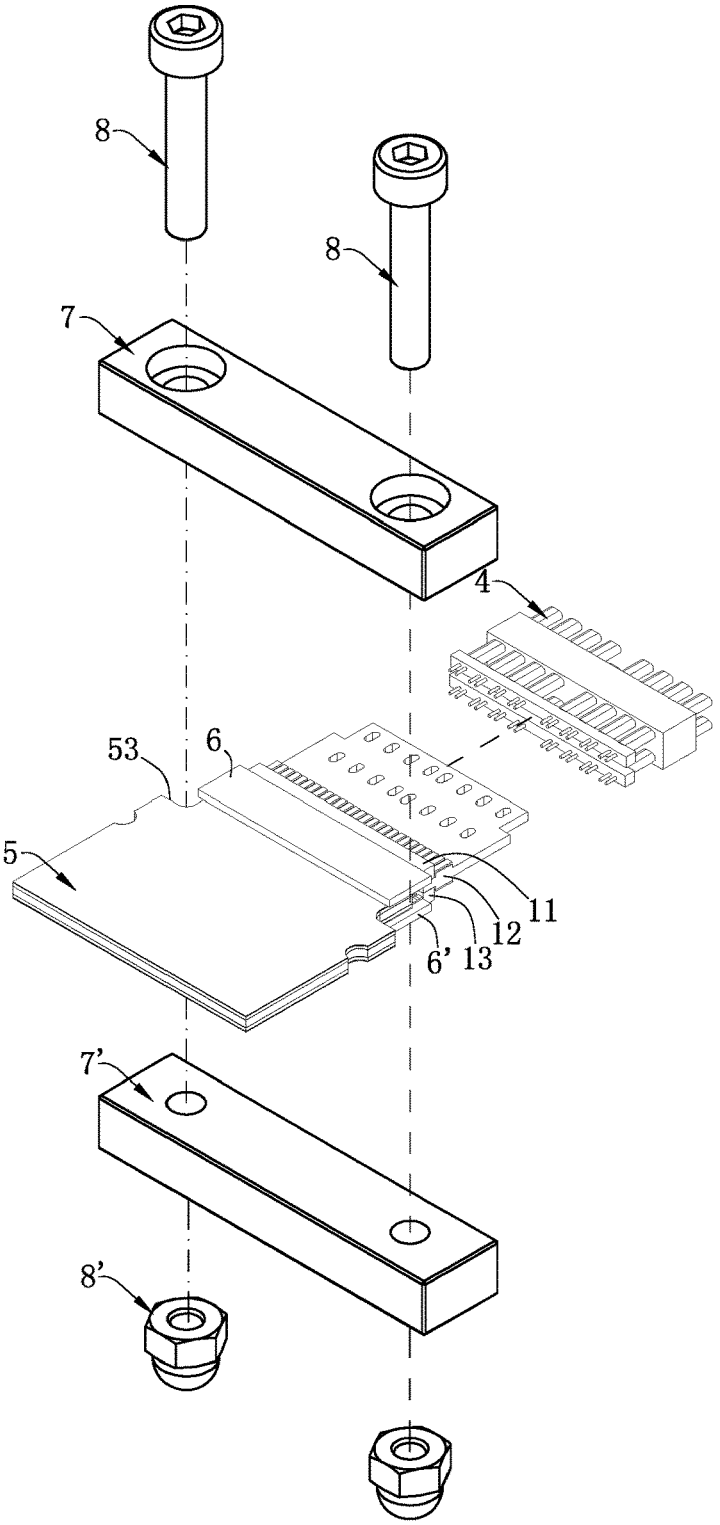
FIG. 7 is another three-dimensional exploded view of the electrical connection device according to one embodiment of the present invention.
Figure 10:
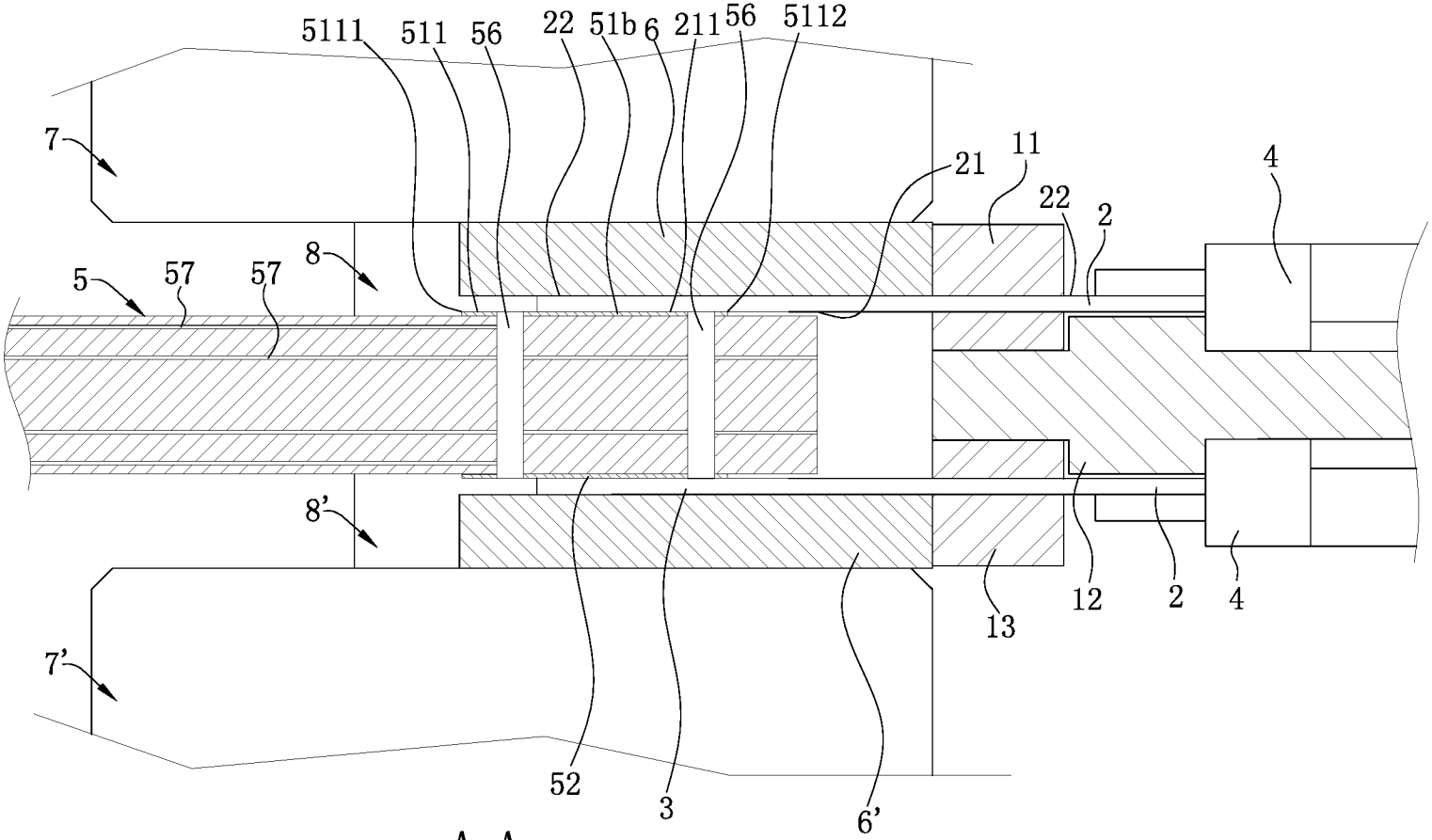
FIG. 10 is a side sectional view of the electrical connection device according to one embodiment of the present invention along an A-A direction.
Figure 11:
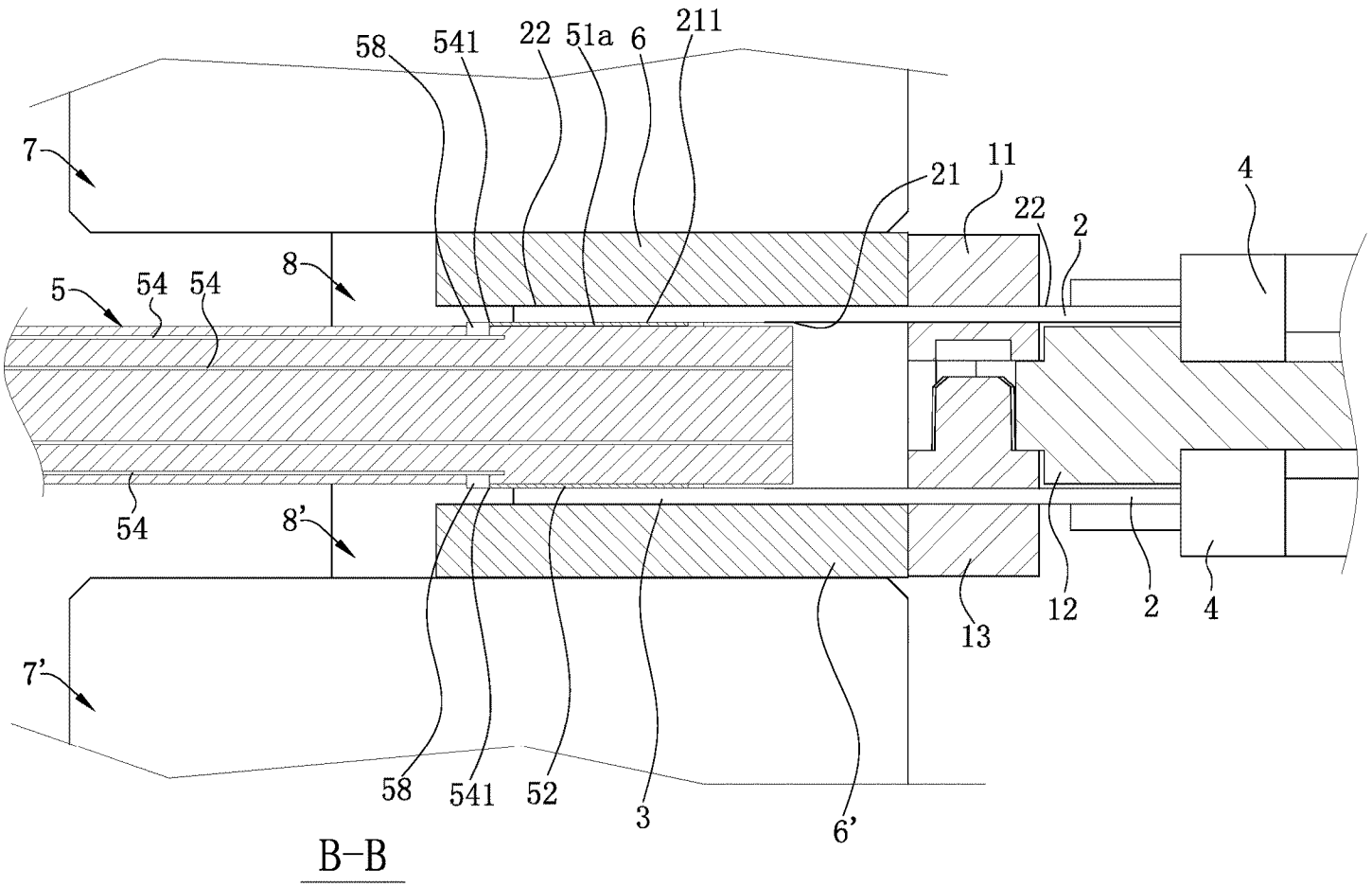
FIG. 11 is a side sectional view of the electrical connection device according to one embodiment of the present invention along a B-B direction.

As shown in FIG. 1, FIG. 7 and FIG. 10, an electrical connection device 100 according to one embodiment of the present invention includes: a first insulating body 1, formed by an upper body 11, a middle body 12, and a lower body 13; a strip-shaped first conductor 2 accommodated in the first insulating body 1, wherein the first conductor 2 as a whole is arranged horizontally, and is configured to electrically connect backward with a first docking component 4; a second docking component 5, including a second conductor 51 located below the first conductor 2 and docking with the first conductor 2; an elastic body 6 located above the first conductor 2 and downwardly abutting the first conductor 2; and a pressing piece 8, providing a downward force to make the first conductor 2 downwardly abut the second conductor 51.

Figure 6:
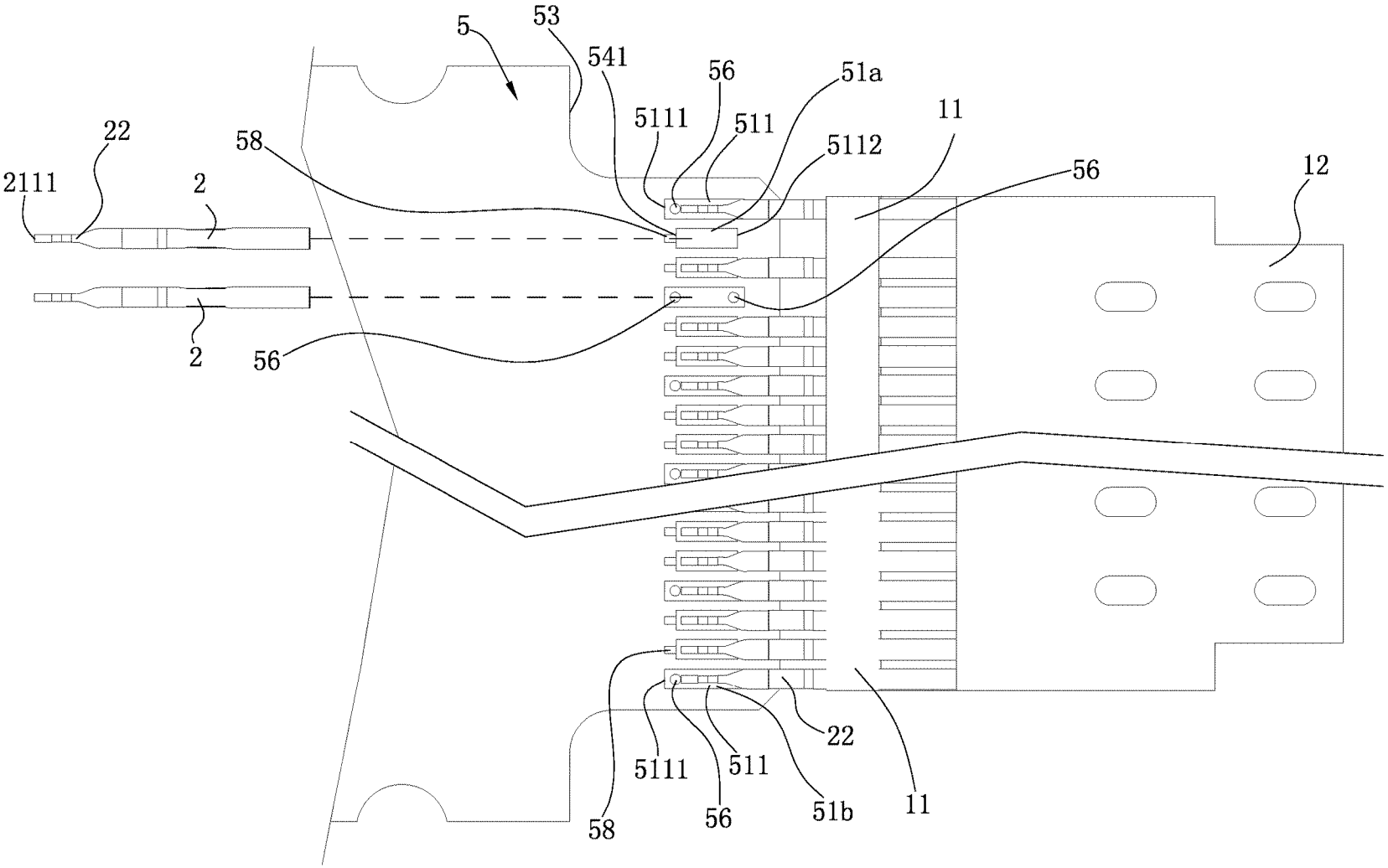
FIG. 6 is a local top view of the electrical connection device according to one embodiment of the present invention.

As shown in FIG. 6, FIG. 7 and FIG. 10, a bottom surface 21 of the first conductor 2 has a front edge 2111 (in other embodiments, the front edge 2111 can be a curve or a polyline), and a contact area 211 extends backward from the front edge 2111. The second conductor 51 has a front end 5111 and a rear end 5112 opposite to each other and a top surface 511 connecting the front end 5111 and the rear end 5112. An insulating piece 7 is located between the elastic body 6 and the pressing piece 8, and downwardly abuts the elastic body 6. The pressing piece 8 provides a downward pressing force to downwardly abut the insulating piece 7, thus making the insulating piece 7 press the elastic body 6. The elastic body 6 presses the first conductor 2 and the second conductor 51 to be in a tight contact. The contact area 211 is completely attached to the top surface 511. The front edge 2111 is located between the front end 5111 and the rear end 5112, and abuts the top surface 511. The rear end 5112 abuts the contact area 211. An area 22 of the first conductor 2 pressed by the elastic body 6 extends to be right above the front edge 2111. The contact area 211 is narrow at a front and wide at a rear thereof. A length of the front edge 2111 is ⅓ of a length of the front end 5111.

Figure 8:
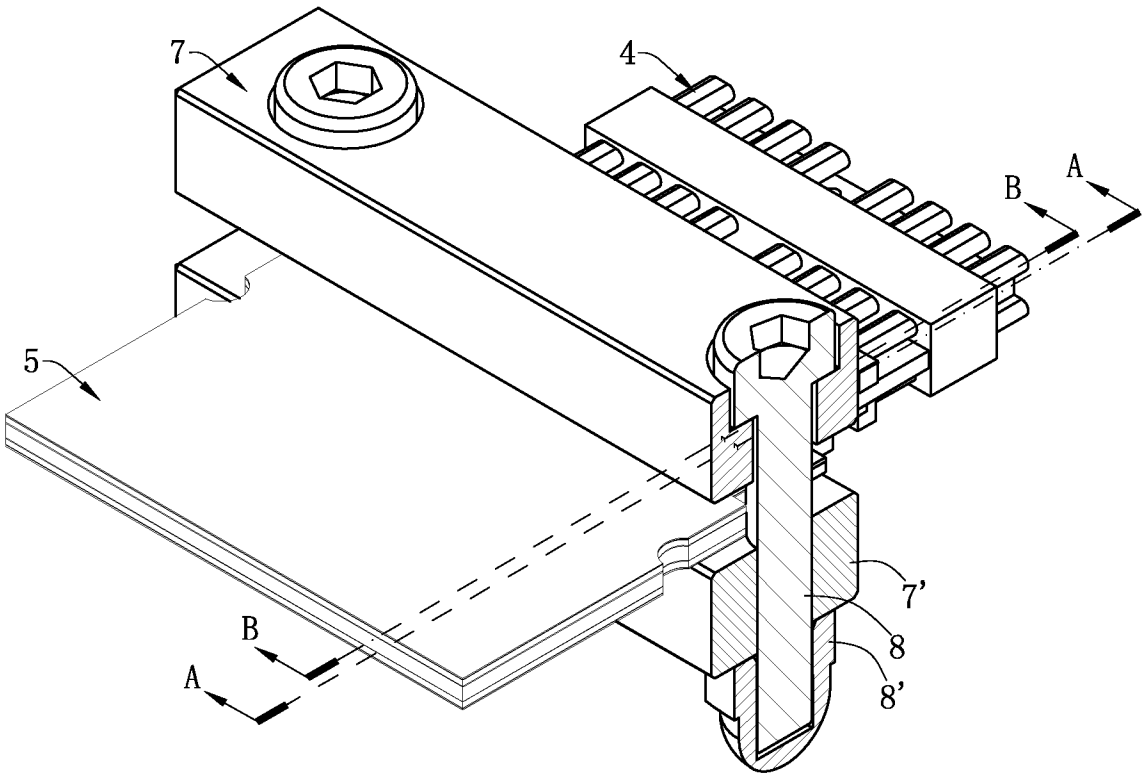
FIG. 8 is a three-dimensional assembled view of the electrical connection device according to one embodiment of the present invention and a first docking component.
Figure 9:
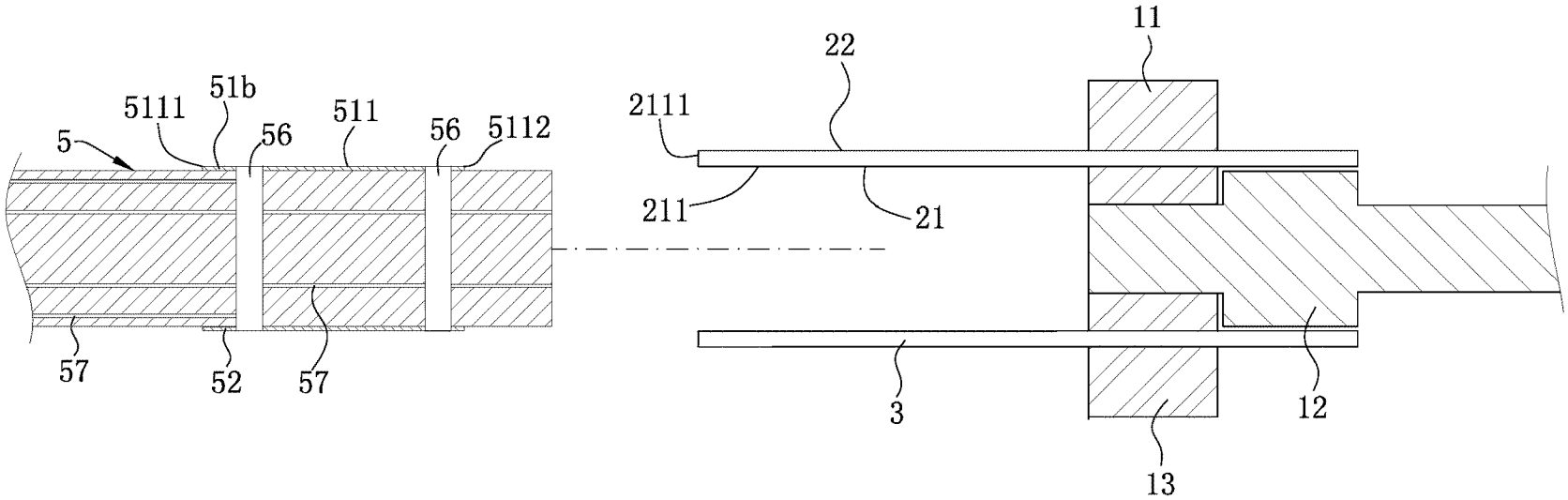
FIG. 9 is a local side sectional view of the electrical connection device according to one embodiment of the present invention along a C-C direction.

As shown in FIG. 7 and FIG. 8, an elastic component 6' is located below a third conductor 3 and upwardly abuts the third conductor 3. An insulating block 7' upwardly abuts the elastic component 6'. A pressing component 8' provides an upward force to abut the insulating block 7', thus making the third conductor 3 upwardly abut a fourth conductor 52. The pressing piece 8 is a screw bolt passing through the insulating piece 7 and the insulating block 7' from above to below, and the pressing component 8' is a screw nut matching with the screw bolt. The second docking component 5 has a notch 53 spaced away from the pressing piece 8.

The elastic body 6 and the elastic component 6' are made of a material with good elasticity, such as rubber. The elastic body 6 and the elastic component 6' can elastically press the first conductor 2 without damaging the first conductor 2. Preferably, the elastic body 6 is a silicone rubber.

As shown in FIG. 4, FIG. 5, FIG. 10 and FIG. 11, the second docking component 5 is a circuit board. The second conductor 51 includes a signal pad 51*a* and a grounding pad 51*b*. The circuit board has a signal wire 54 and a connector 58 which is electrically connected to the signal wire 54, and the connector 58 has a connecting point 541 abutting the signal pad 51*a*. In a horizontal projection, the connecting point 541 is located between the front end 5111 and the front edge 2111. Preferably, the connecting point 541 is electrically connected to the front end 5111. The circuit board is provided with an accommodating hole 55, and a conducting piece 56 is accommodated in the accommodating hole 55. The grounding pad 51*b* and the fourth conductor 52 are electrically connected with each other via the conducting piece 56, and the conducting piece 56 is located right below the contact area 211. Further, the accommodating hole 55 upwardly passes through the grounding pad 51*b*, so that the conducting piece 56 is exposed on the top surface 511 and abuts the contact area 211. The conducting piece 56 is located between the front edge 2111 and the front end 5111. The circuit board has a grounding wire 57, and the conducting piece 56 is electrically connected to the grounding wire 57. The number of grounding wires 57 is four, and in other embodiments, the number of the grounding wires 57 can be other numbers.

The conducting piece 56 is made of a material with good electrical conductivity, such as a solid copper cylinder or a hollow copper-coated layer. In certain embodiments, there are two conducting pieces 56. In other embodiments, the number of the conducting piece 56 can be one, or there can be more than two conducting pieces 56. Alternatively, the grounding wire 57 can be directly electrically connected to the grounding pad 51*b* without providing the conducting piece 56.

In other embodiments, the first insulating body 1 can be made to be an integral one-piece. In other words, the upper body 11, the middle body 12 and the lower body 13 are formed integrally by injection molding.

In certain embodiments, the pressing piece 8 and the pressing component 8' can be other pressing components (not shown in the drawings) rather than screw bolt and screw nut, and can even be made to be one-piece rather than separable from each other. The pressing piece 8 can directly press the elastic body 6 without providing the insulating piece 7, and the pressing component 8' can directly press the elastic component 6' without providing the insulating block 7'.

The second docking component 5 can be other docking components (not shown in the drawings), such as a male connector (not shown in the drawings), rather than a circuit board.

Certain embodiments of the present invention have the following beneficial effects:

1. The strip-shaped first conductor 2 is arranged horizontally as a whole and docks the second conductor 51, and the first conductor 2 does not bend in a vertical direction, which helps both to be in tight contact. The first conductor 2 has a simple structure, and therefore is easy to manufacture. In the subsequent pressing process, the deformation of the first conductor 2 along a vertical direction is little and can even be ignored, thereby reducing metal fatigue and extending the life cycle thereof. The contact area 211 is completely attached to the top surface 511, the front edge 2111 is located between the front end 5111 and the rear end 5112 and abuts the top surface 511, and the rear end 5112 abuts the contact area 211, so that there is no open circuit caused by a branch between them, thereby effectively decreasing the negative influence of the electrical stub effect, and enhancing the quality of high-frequency signal transmission.

2. The elastic body 6 and the elastic component 6' elastically press the first conductor 2 and the third conductor 3 downwardly and upwardly, respectively, so that the first conductor 2 and the third conductor 3 cannot be easily damaged.

3. One conducting piece 56 abuts the contact area 211, and another conducting piece 56 abuts the grounding pad 51*b*, and is located between the front edge 2111 and the front end 5111. Both conducting pieces 56 are electrically connected to the grounding wire 57, thereby enhancing the grounding effect.

4. The connecting point 541 is electrically connected to the signal pad 51*a*, and is electrically connected to the front end 5111, thereby eliminating open circuits among the signal wire 54, the signal pad 51*a* and the first conductor 2. By means of improvement in terms of details, the electrical connection device 100 has excellent high-frequency signal transmission performance.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connection device, comprising:

a first insulating body;

a strip-shaped first conductor, accommodated in the first insulating body, wherein the first conductor as a whole is arranged horizontally, and is configured to electrically connect backward with a first docking component, a bottom surface of the first conductor has a front edge, and a contact area extends backward from the front edge;

a second docking component, comprising a second conductor located below the first conductor, wherein the second conductor has a front end and a rear end opposite to each other and a top surface connecting the front end and the rear end;

an elastic body, located above the first conductor and downwardly abutting the first conductor;

a pressing piece, configured to provide a downward force to make the first conductor downwardly abut the second conductor, wherein when the pressing piece applies pressure, the contact area is completely attached to the top surface, the front edge is located between the front end and the rear end and abuts the top surface, and the rear end abuts the contact area; and a third conductor, accommodated in the first insulating body, and arranged to be vertically symmetric with the first conductor;

wherein the second docking component further comprises a fourth conductor, arranged to be vertically symmetric with the second conductor.

2. The electrical connection device according to claim 1, wherein an area of the first conductor pressed by the elastic body extends to the right above the front edge.

3. The electrical connection device according to claim 1, wherein the contact area is narrow at a front and wide at a rear thereof.

4. The electrical connection device according to claim 1, wherein the second docking component is a circuit board, the second conductor comprises a signal pad, the second docking component has a signal wire and a connector which is electrically connected to the signal wire, the connector has a connecting point abutting the signal pad, and the connecting point is located between the front end and the front edge in a front-rear direction.

5. The electrical connection device according to claim 4, wherein the connecting point is electrically connected to the front end.

6. The electrical connection device according to claim 1, further comprising:

an insulating piece, located between the elastic body and the pressing piece and downwardly abutting the elastic body, wherein the pressing piece downwardly abuts the insulating piece;

an elastic component, located below the third conductor and upwardly abutting the third conductor;

an insulating block, upwardly abutting the elastic component; and a pressing component, configured to provide an upward force to abut the insulating block to make the third conductor upwardly abut the fourth conductor.

7. The electrical connection device according to claim 6, wherein the pressing piece is a screw bolt passing through the insulating piece and the insulating block from above to below, and the pressing component is a screw nut matching with the screw bolt.

8. The electrical connection device according to claim 1, wherein the second docking component is a circuit board, the second conductor comprises a grounding pad, the circuit board is provided with an accommodating hole, a conducting piece is accommodated in the accommodating hole, and the second conductor and the fourth conductor are electrically connected with each other via the conducting piece.

9. The electrical connection device according to claim 8, wherein the conducting piece is located right below the contact area.

10. The electrical connection device according to claim 8, wherein the accommodating hole upwardly passes through the second conductor to expose the conducting piece on the top surface.

11. The electrical connection device according to claim 10, wherein the conducting piece abuts the contact area.

12. The electrical connection device according to claim 8, wherein the conducting piece is vertically arranged, and the conducting piece is located between the front edge and the front end in a front-rear direction.

13. The electrical connection device according to claim 8, wherein the circuit board has a grounding wire, and the conducting piece is electrically connected to the grounding wire.

14. The electrical connection device according to claim 1, wherein a length of the front edge is ⅓ of a length of the front end.

15. The electrical connection device according to claim 1, wherein the elastic body backwardly abuts the first insulating body.

16. The electrical connection device according to claim 1, wherein the second docking component has a notch spaced away from the pressing piece.

* * * * *